US005461826A

United States Patent [19]

Heckel et al.

[11] Patent Number: 5,461,826

[45] Date of Patent: Oct. 31, 1995

[54] SAFETY DEVICE FOR ELECTRICAL OPENERS FOR A VEHICLE

[75] Inventors: Robert J. Heckel, Cormeilles; Enrico Fin, Paris; Achim R. Gier, Garches; Pascal Bonduel, Sully S/Loire, all of France

[73] Assignee: Rockwell Body and Chassis Systems, France

[21] Appl. No.: 87,835

[22] Filed: Jul. 2, 1993

[30] Foreign Application Priority Data

Jul. 10, 1992 [FR] France ..... 92 08620

[51] Int. Cl.[6] ..... E05F 15/02

[52] U.S. Cl. ..... 49/28; 49/352

[58] Field of Search ..... 49/26, 28, 31, 49/348, 349, 350, 351, 352

[56] References Cited

U.S. PATENT DOCUMENTS

| | | | |
|---|---|---|---|
| 2,044,712 | 6/1936 | Monroe | 49/26 X |
| 2,649,300 | 8/1953 | Launder | 49/26 X |
| 2,817,512 | 12/1957 | Christen | 49/26 |
| 2,883,183 | 4/1959 | Finsterwalder et al. | 49/26 |
| 3,742,646 | 7/1973 | Piech | 49/28 |

FOREIGN PATENT DOCUMENTS

| | | |
|---|---|---|
| 1941256 | 2/1971 | Germany . |
| 3215203 | 10/1983 | Germany . |
| 2107387 | 4/1983 | United Kingdom . |

*Primary Examiner*—Peter M. Cuomo
*Assistant Examiner*—Jerry Redman

[57] ABSTRACT

In a window lifter of the cable type, comprising a motor for driving the cable bearing a slide (6) linked to a second slide (7) supporting the window, the two slides (6, 7) may be coupled via an elastic tension element (16) and one (6) of the slides is fitted with an electrical switch (17), associated with the second slide (7) so as to change state when the load on the slide (7) carrying the window (8) exceeds a predetermined value and when the elastic element (16) undergoes an extension corresponding to the separation between the slides; the switch (17) forms part of an electrical supply circuit for the motor, capable of reversing its direction of rotation when this switch (17) changes state, so as to free the movable member from an obstacle in its path. This electromechanical safety device has a simple structure and a low manufacturing cost.

14 Claims, 7 Drawing Sheets

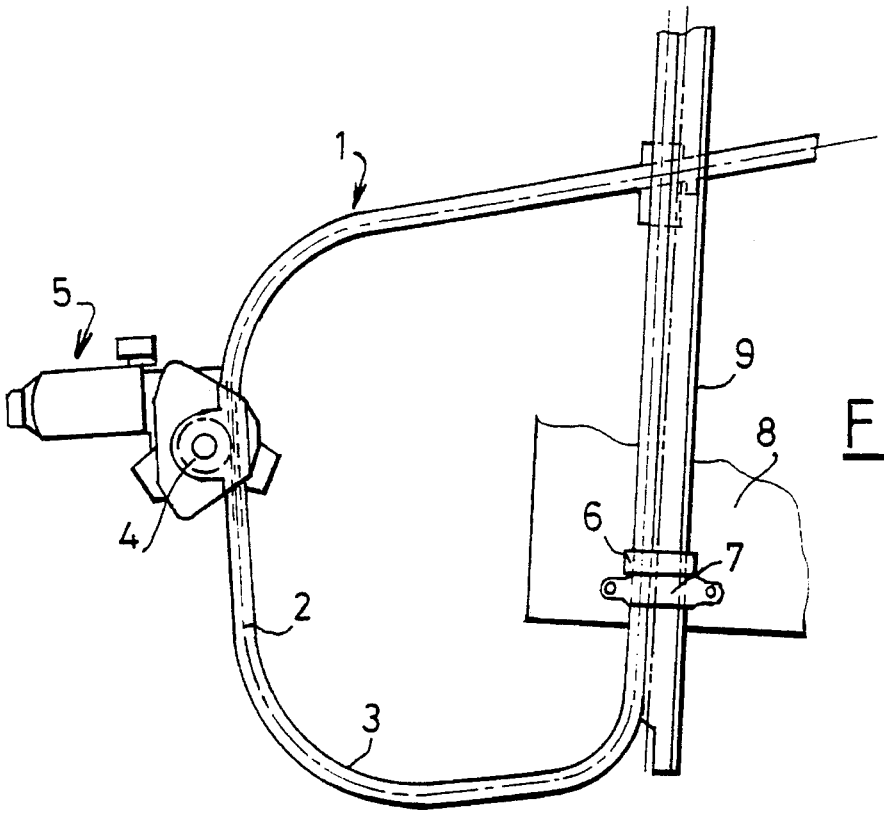
FIG.1
FIG.2
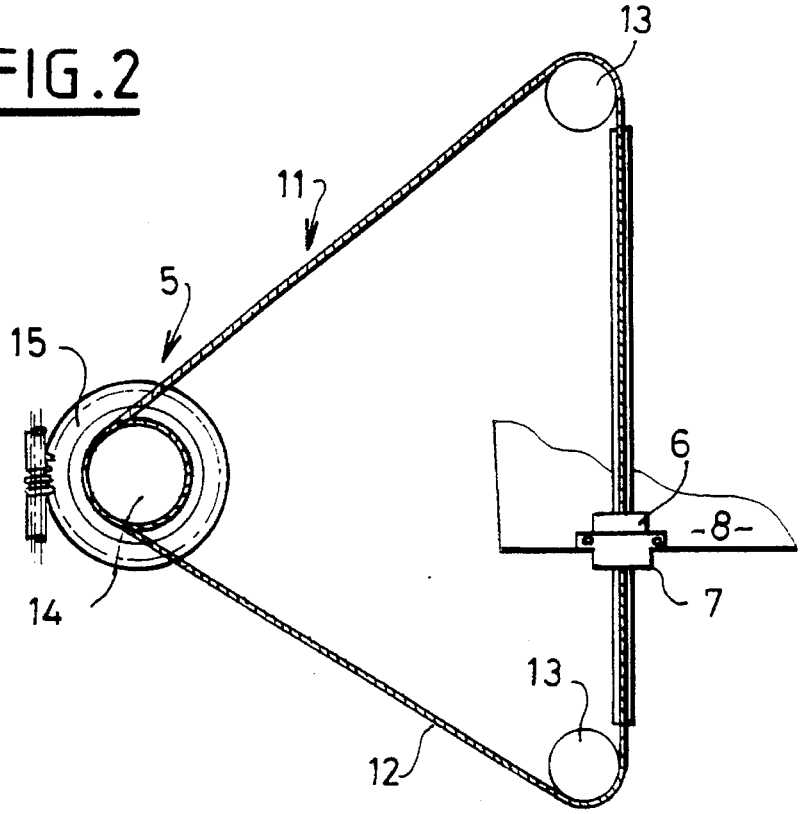

SAFETY DEVICE FOR ELECTRICAL OPENERS FOR A VEHICLE

BACKGROUND OF THE INVENTION

1. Field of the Invention

Subject of the present invention is a safety device for electrical openers for a vehicle, especially window lifters of the cable or swing-arm/toothed-sector type and sunroofs, comprising a motor, a movable member, and a kinematic chain for driving this movable member by the motor.

2. Description of the Related Art

Currently, there are known to exist three types of window lifter on motor vehicles: window lifters of the rack-cable type, window lifters of the twisted-cable (Bowden cable) type and window lifters of the am and toothed-sector type. The invention relates to these window lifters and to other electrical openers having similar operating conditions, most particularly to sunroofs which are driven by cables.

When an obstacle lies in the path for closing the window (or the sunroof), the system must recognize the presence of an abnormal phenomenon and, if the load on the window or the sunroof exceeds a limiting value, the window must not continue its travel, but stop and at least free the load. This freeing of the load may be obtained either by freeing the window which is lowered under a small load or under the effect of its own weight if the friction in the lateral seal allows it, or by reversing the motion of the window, which is then forcibly lowered.

In order to solve this problem, various electronic and electromechanical safety devices have already been proposed which have, among other drawbacks, that of being relatively expensive by reason of their complexity. This high cost of manufacturing is obviously an obstacle to their widespread use.

Moreover, U.S. Pat Nos. 2,130,764 and 2,461,085 describe swing-door safety devices in which switches work upon closing. Consequently, if the wiring is defective, the safety system does not operate.

Furthermore, these two prior devices include springs, the working travel of which is great, and therefore the sensitivity to tripping is low.

SUMMARY OF THE INVENTION

The object of the invention is to provide a electromechanical safety device for the electrical openers mentioned hereinabove, which is simple to manufacture, inexpensive, more reliable and more sensitive than the aforementioned devices.

The device, envisaged by the invention, comprises electromechanical means for coupling and detecting a load between a first driving element of the said chain and a second driven element, supporting the movable member, these means being arranged so as to automatically uncouple the two, driving and driven, elements from each other in the event of a load exceeding a predetermined value being detected which opposes the travel of the window.

According to one embodiment of the invention, intended for window lifters of the cable type and for sunroofs, the electromechanical coupling and load-detecting means are produced between a first, driving slide held fast to the cable and a second, driven slide held fast to the movable member, these means being arranged so as to automatically uncouple the two slides from each other in the event of the said load exceeding a predetermined value being detected.

Thus, if an obstacle, when closing the window, for example a hand or another part of a passenger's body, is interposed the electromechanical system detects this load. If the latter exceeds a certain limit, the system reacts by reversing the direction of rotation of the motor, thus lowering the window and freeing the obstacle.

Such an electromechanical safety device has a relatively simple structure and is inexpensive.

The safety device, envisaged by the invention, is also intended for vehicle window lifters of the type comprising a kinematic chain provided with an output gear of a geared motor unit, a toothed sector forming the driving element in engagement with this gear, and a spring arm forming the driven element, mechanically linked to the sector and carrying the window, as well as electromagnetic means for coupling and detecting a load between the toothed sector and the swing arm, these means being arranged so as to automatically uncouple the toothed sector and the swing arm from each other in the event of a load exceeding a predetermined value being detected.

According to the invention, this device is characterized in that the coupling and load-detecting means comprise a magnet fixed to a first element, a ferromagnetic plate carried by the other element, to which plate the magnet normally clings, linking the two elements, and an electrical switch mounted on the first element so as to be kept by the second element in a first state when the two elements are linked by the attractive force of the magnet on the plate, and to switch into a second state when a load greater than the attractive force of the magnet moves the driven element away from the driving element carrying the magnet.

The electrical opener, also envisaged by the invention, comprises a motor, a cable for driving a movable member, such as a window or sunroof, and a kinematic linkage chain between the motor and the movable member. In accordance with the invention, the opener comprises a first, driving slide rigidly secured to the cable, a second, driven slide rigidly secured to the movable member, and the aforementioned electromechanical safety device.

Other particular features and advantages of the invention will appear during the description which will follow, given with reference to the attached drawings which illustrate various embodiments thereof by way of non-limiting examples.

BRIEF DESCRIPTION OF THE DRAWINGS

FIG. 1 is a view, in simplified partial elevation, of an electrical opener of the rack-cable type in accordance with the invention.

FIG. 2 is a view, in simplified partial elevation, of an opener constituted by an electrical window lifter according to the invention, of the Bowden-cable type.

DESCRIPTION OF THE PREFERRED EMBODIMENTS

Figure 4:
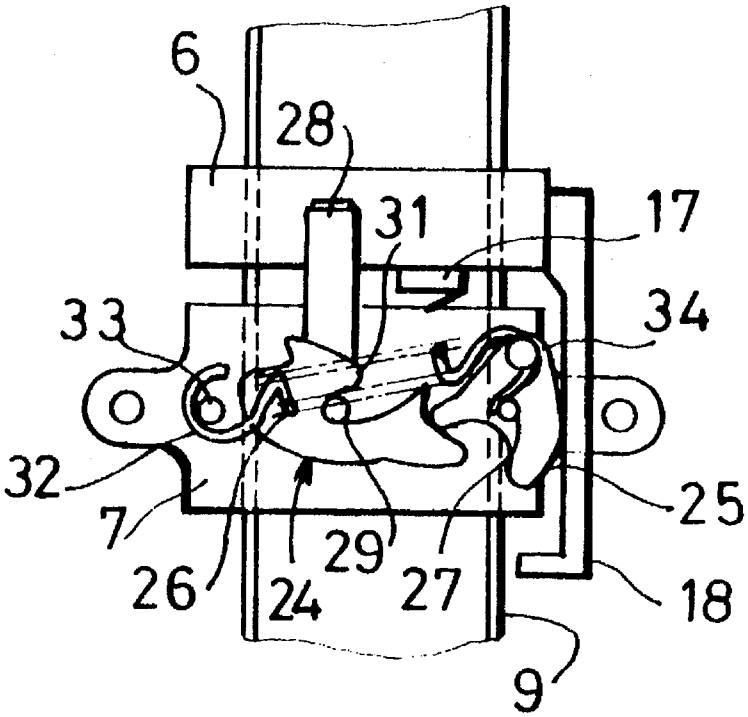
FIGS. 3, 4, 5, 6 are views, in elevation, of four embodiments of the electromechanical safety device according to the invention.

The electrical opener 1 represented in FIG. 1 is a window lifter of the rack-cable 2 type sliding in a sheath 3. The cable 2 meshes with an output gear 4 of a geared motor unit 5. A driving slide 6 is fixed to the rack cable 2 and connected to a driven slide 7 supporting a window 8, the two slides 6 and 7 being able to slide along a guide rail 9.

These slides are connected via electromechanical means for coupling and detecting a load between the two slides, several embodiments of which will be described hereinbelow with reference to FIG. 3 to 15.

The window lifter 11 represented in FIG. 2 is of the type having a Bowden cable 12 wound around guide pulleys 13 and around a drum 14 held fast to the toothed wheel 15 of the geared motor unit 5. The slide 6 is fixed to the cable 12 and is mechanically linked to the slide 7 supporting the window 8 via electromechanical means for coupling and detecting load between the two slides, according to one of the embodiments which will be described hereinbelow.

Figure 3:
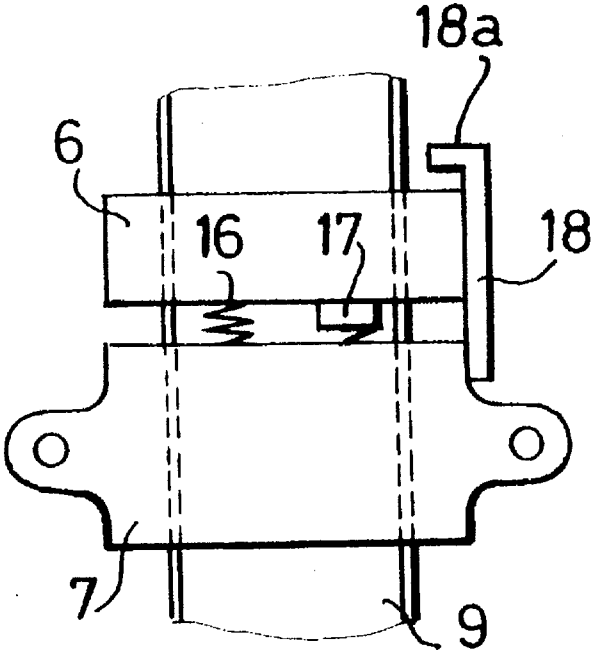

FIG. 3 illustrates the simplest and most general operating layout of the invention: the two slides 6, 7 are coupled via a prestressed elastic tension element 16, constituted in the example shown by a helical spring, and one of the slides, for example the slide 6, is fitted with an electrical switch 17 placed opposite the second slide 7 so as to be able to interact with the latter. On account of the interposition of the spring 16 between them, the two slides 6, 7 are separated by a corresponding gap, put to good use in order to place the switch 17 therein. Means for limiting the relative movement of the slides 6, 7 are provided, for example as represented, a hook 18 fixed to one of the slides (7 in FIG. 3). The hook 18 extends along the other slide 6 and its curved-over end 18*a* enables the travel between the two slides to be limited.

If the load on the movable member carried by the slide 7 increases as a result of the interposition of an obstacle to closing, the cable 2 or 12 tends to pull the slide 6 upwards, whereas the load on the movable member tends to push the slide 7 downwards, the spring 16 keeping the two slides held together. An increase in the load on the movable member, and therefore between the two slides 6, 7, causes a correlative extension of the spring 16. As long as this extension does not exceed a certain limit, the switch 17 is in a defined state: in FIG. 3 it is in the pushed-in position or starting position. Beyond this limit, an additional load, and therefore an additional extension of the spring 16, frees the switch 17 sufficiently for it to change state. It then suffices to make use of a supply circuit for the motor of the geared motor unit 5 which, in the case where the switch 17 changes state, reverses the direction of rotation of the motor and therefore lowers the movable member down to the desired level in order to free the obstacle.

Figure 9:
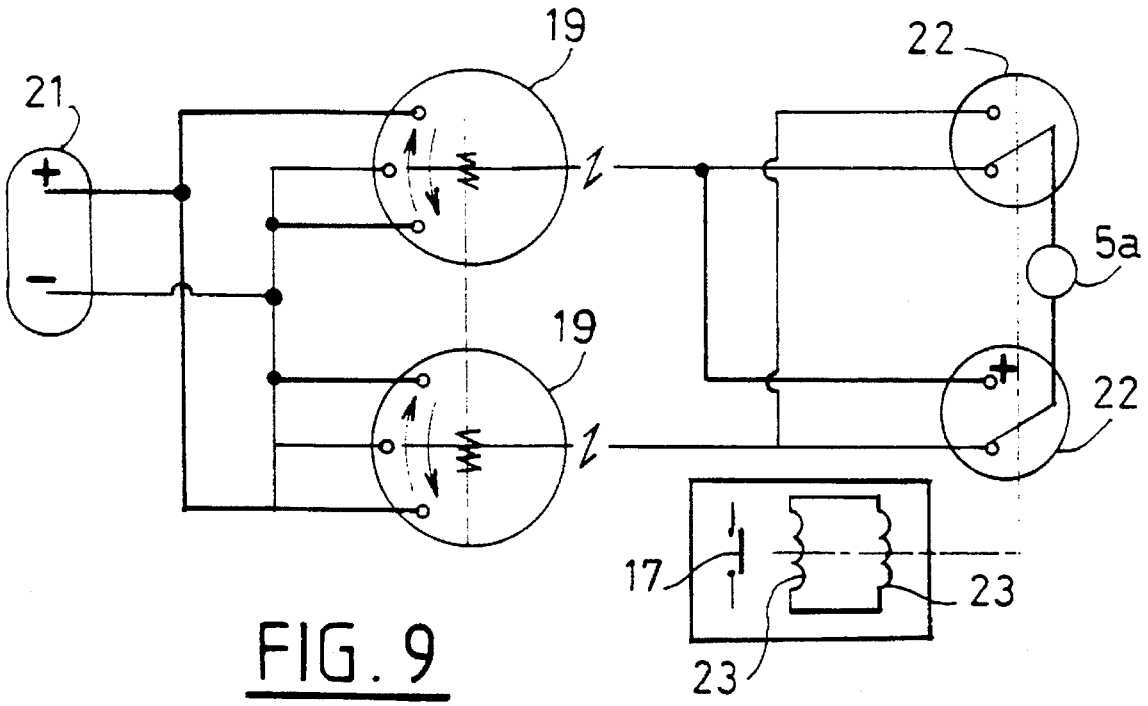
FIGS. 9, 10, 11 and 12 are electrical diagrams illustrating four possible embodiments of the electrical supply circuit for the safety devices represented in FIG. 1 to 8.
Figure 10:
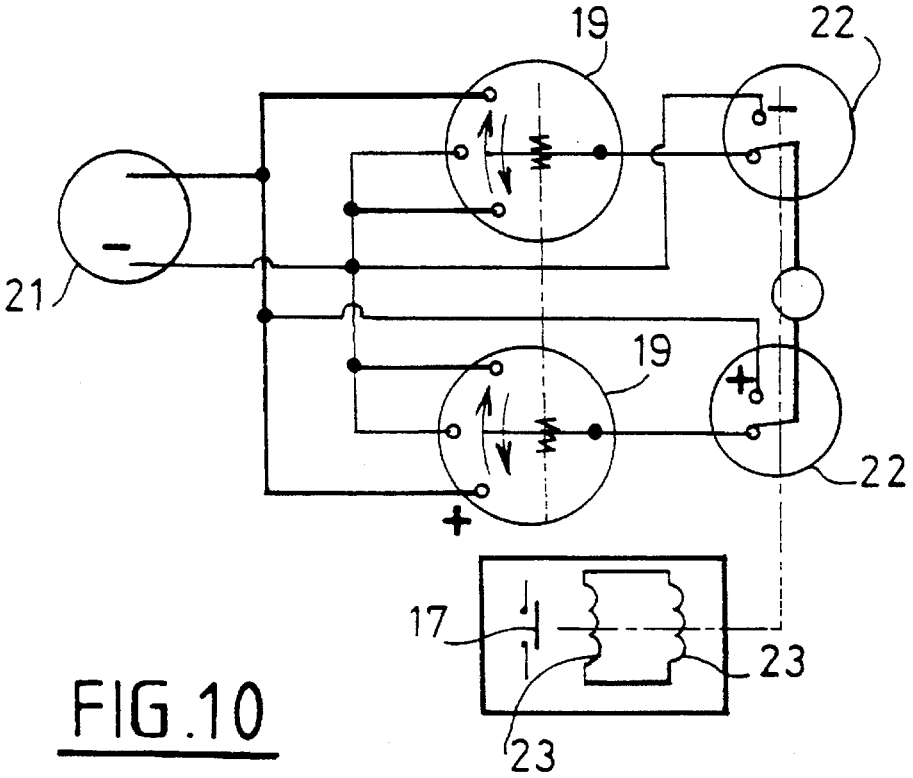

FIG. 9 and 10 show examples of suitable electrical supply circuits, called "electrical memory" circuits. This involves a common window lifter (or sunroof) control circuit, known per se, comprising an up/down button 19, supplied by a battery 21, and with which are combined two relays 22, 23 for reversing the direction of travel, which are controlled by the weighing switch 17 connected to the motor 5*a* of the geared motor unit 5. In this kind of circuit, it suffices to keep the weighing switch 17 in operation just for the time necessary for the relays to switch. Subsequently, even if the switch 17 is released, the relays remain in this detection position by means of a self-supply system, lowering the window down to the resetting point. Since this supply circuit is well known per se, it does not require more detailed description.

The system for holding the relays 22, 23 is supplied as long as pressure is kept on the control button 19.

The supply circuit of FIG. 10 is another common construction of a control circuit, and differs from the circuit of FIG. 9 solely by the fact that the + and the − of the battery 21 are brought continuously to the reversing switches of the relays 22. The supply for the safety system is therefore independent of the position of the control button 19 so that, after the detection, the movable member is lowered, even after the button 19 has been released, and this is down to a resetting point. The circuit of FIG. 10 is therefore one with an electrical memory circuit with self-supply.

The safety device of FIG. 4 comprises means for coupling the two slides 6, 7 which include a system having two catches 24, 25 pivoted on respective pins 26, 27 fixed to one of the slides, namely the slide 7 in the example described. This coupling device also comprises a finger 28 held fast to the slide 6, carrying a terminal stud 29 engaged in a nose 31 of the catch 24, and a spring 32, one end of which is fixed at 33 to the slide 7 whereas its other end is attached at 34 to the second catch 25. The latter is thus stressed elastically by the spring 32, bearing against the first catch 24, in such a way that the finger 29 is kept caught in the first catch 24 as long as the load transmitted to the finger 29 via the catch 24 remains below a predetermined value. One of the slides 6, 7, namely the slide 6 in the example described, is equipped with an electrical switch 17 which occupies the gap between the two slides and interacts with the slide 7 so as to change state when the aforementioned load exceeds the said predetermined value and when the finger 29 disengages from the catch 24.

Figure 11:
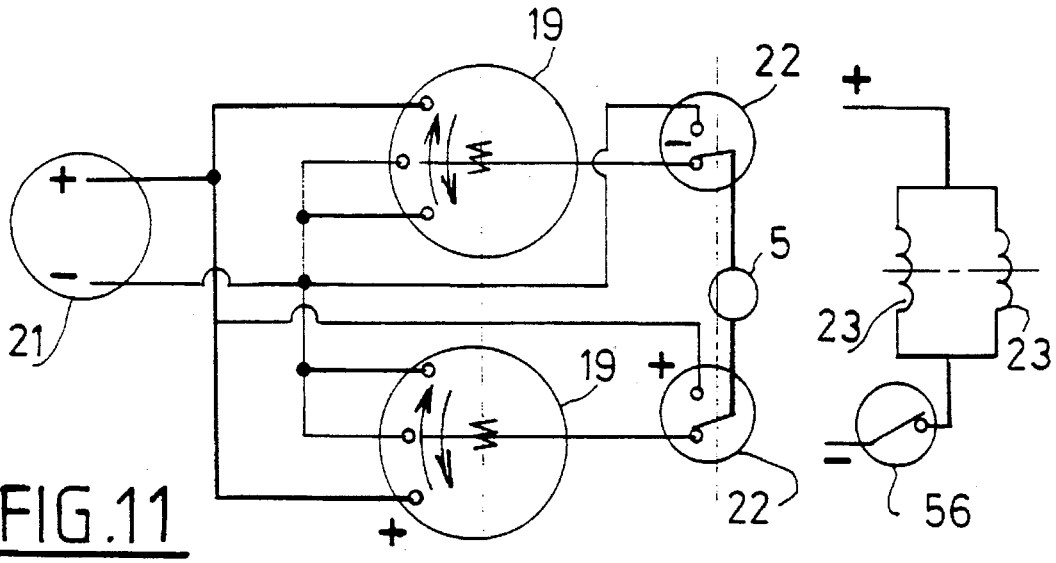
Figure 12:
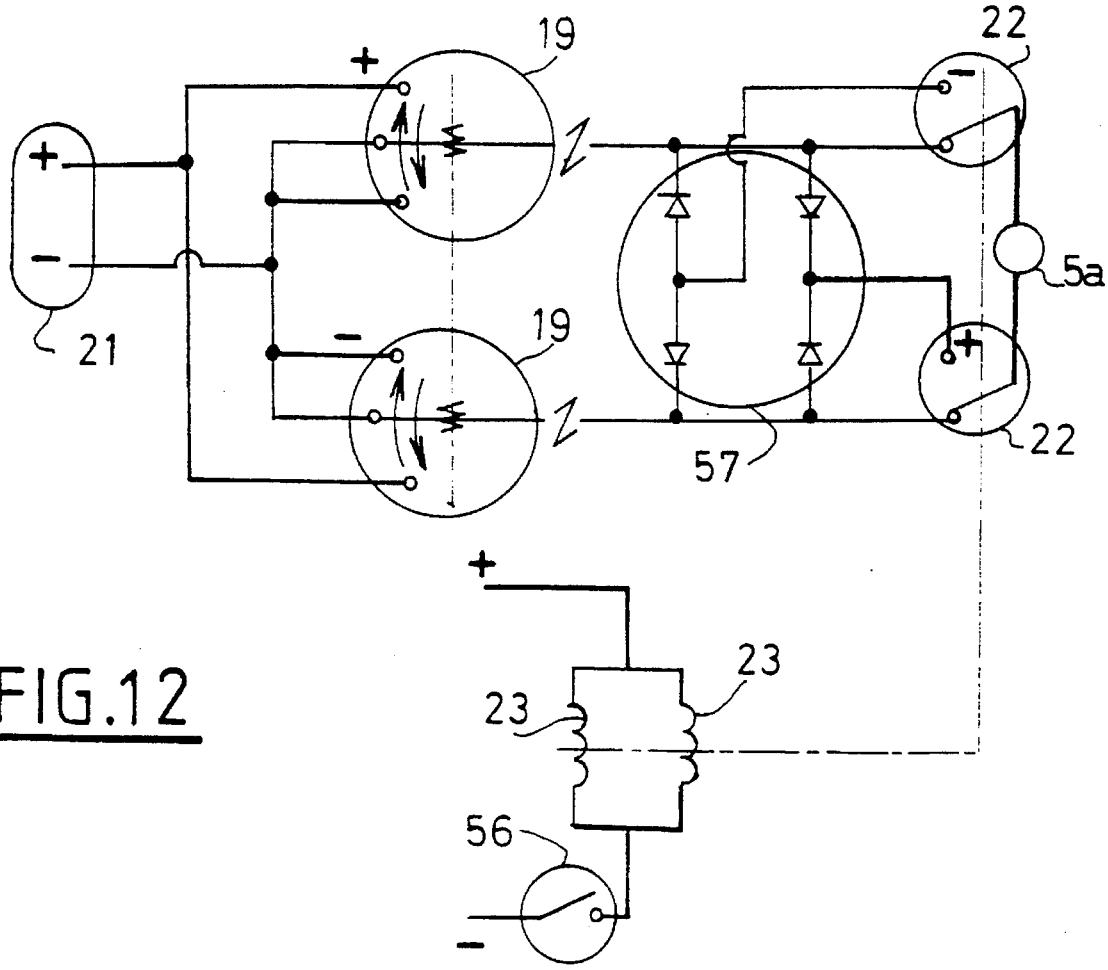

The switch 17 forms part of an electrical supply circuit for the motor of the geared motor unit 5, which may either be the circuit of FIG. 11 or that of FIG. 12, as for the safety device illustrated in FIG. 3.

Figure 5:
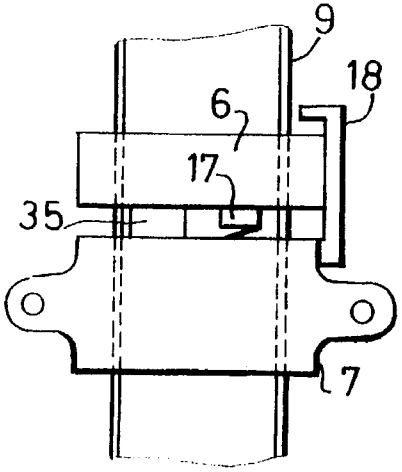

The embodiment of the safety device illustrated in FIG. 5 comprises, as coupling means between the slides 6, 7, a magnet 35 fixed to one of the slides and clinging to a ferromagnetic plate, which is not shown, fixed to the other slide. A switch 17 is fixed to one of the slides 6, 7 in the gap separating them, and forms part of an electrical supply circuit according to FIG. 11 or FIG. 12.

The slide 7 carries a hook 18 for limiting the travel between the two slides, similar to that of FIG. 3.

The attractive force of the magnet 35 keeps the two slides 6, 7 joined together as long as the load experienced by the slide 7 carrying the movable member to be moved remains below the attractive force of the magnet 35. When this load exceeds the said attractive force, the two slides 6, 7 separate, the switch 17 changes state and the electrical supply circuit actuates the reversal of the direction of rotation of the motor 5*a*.

The safety devices which have just been described with reference to FIG. 3 to 5 are so-called electrical-memory safety devices, since for these embodiments an electrical layout should be provided which is capable of holding in memory the information that the system has tripped, and therefore consequently of reacting even when the load has disappeared, in order to move the movable member (for example the window) to a given location, for example the down position in order to be sure that the obstacle has been completely freed.

Two other embodiments of the safety device according to the invention will now be described with reference to FIG. 6 to 8, in which embodiments the safety device has a "mechanical" memory. This means that, even when the load is no longer above the predetermined limit, for example the intervention of the safety system and therefore the reversal of the movable member, the system holds in memory the fact that the overload phenomenon has taken place. The disengaged position then remains until the moment when the device is deliberately reset, and therefore returned to the starting position.

Figure 6:
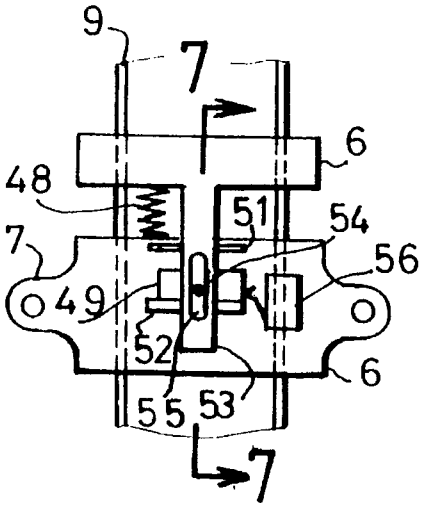
Figure 7:
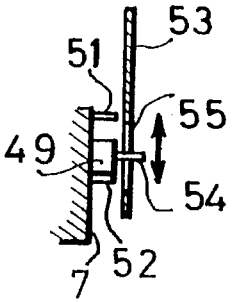
FIG. 7 is a view in partial section along 7—7 of FIG. 6.

FIG. 6 and 7 show a safety device in which the means for coupling the slides 6, 7 comprise a tension spring 48 connecting the slides 6, 7. One of these, for example the slide 7 carrying the movable member, is provided with a magnet 49 which can move between two stable positions by means of driving and guiding means carried by the slide 6. The magnet can move between two plates 51, 52 of ferromagnetic material which are fixed to the slide 7 at a suitable distance apart on either side of the element 49.

The means for driving and guiding the magnet 49 comprise, in the example represented, a finger 53 projecting from the slide 6 and extending opposite the magnet 49 which is fitted with a rod 54 which can slide in a guide slot 55 made in the finger 53. The two stable positions of the magnet 49 are those in which it clings to one or other of the two plates 51 and 52. In addition, the magnet 49 interacts with an electrical switch 56 which may adopt two states each corresponding to one of the stable positions of the magnet 49: the first stable position being the one in which the two slides 6, 7 are coupled, as represented in FIG. 6, and its second stable position being the one in which they remain coupled, but further apart, after a load above a predetermined value has been detected. The switch 56 forms part of an electrical supply circuit capable of reversing the direction of rotation of the motor of the geared motor unit when the switch 56 changes state. This change of state is itself caused by the movement of the magnet 49 from its position clinging against the lower plate 52 to its position clinging to the upper plate 51. In its position clinging to the plate 52 (initial position), the magnet pushes the rod of the switch 56, whereas, in its position where it is clinging to the plate 51, the contact between the magnet 49 and the switch 56 is broken.

The position of the switch 56 therefore indicates what state the safety system is in.

The tension spring 48 is prestressed and couples the two slides 6, 7. The device will switch from its initial position, represented in FIG. 6, into its detection position if the extension of the spring 48 is sufficient for the rod 54 of the magnet 49 to be driven into rising motion by the slide 6, and more precisely by the finger 53, the rod 54 then coming into abutment at the lower end of the slot 55. The function of the latter is to allow some free travel of the slide 6 in relation to the slide 7. Thus, as soon as the load on the movable member (window or sunroof) exceeds some predetermined limit, the rod 54 is driven by the slide 6 and the magnet 49, which was clinging against the plate 52, will end up clinging against the plate 51. At the same time, the magnet 49 releases the switch 56 which changes state. From this moment on, the electrical supply circuit, of which the switch 56 forms a part, and which may be either that of FIG. 11 or that of FIG. 12, will reverse the direction of rotation of the motor of the geared motor unit 5. The slide 6 will therefore be pushed downwards, whereas the slot 55 enables the magnet 49 to remain in its detection position, clinging against the plate 51, despite the reversal of the direction of the motion.

FIG. 11 represents a common circuit for controlling an electrical opener, comprising, as the circuits of FIG. 9 and 10, a control button 19 supplied by the battery 21, and two relays 22, 23. This circuit therefore does not require detailed description. As long as the weighing switch 56 is in the detection position, the excitation coils 23 of the relays 22 are supplied, lowering continuing without it being necessary to keep pressure on the control button 19. In fact, once detection has occurred, by the change of state of the switch 56 caused by the movement of the magnet 49, the switch 56 remains in its new state until the moment when the system is "intentionally reset". Consequently, the electrical circuit keeps the switch 56 in its after-detection position, even after the reversal of the motion and therefore elimination of the load.

The circuit of FIG. 12 is similar to that of FIG. 11 but, in addition, it is equipped with a diode bridge 57 which supplies the relays 22, 23. If the button 19 ceases to be pressed, the system stops and the movable member ceases to be lowered, since the + terminals of the relays 22 are no longer supplied, given the arrangement of the diodes of the bridge 57. As with the previous electrical circuits, the circuit of FIG. 12 is known per se and therefore does not require detailed description.

The circuits of FIG. 11 and 12 are mechanical-memory circuits and are therefore not self-supplied.

Figure 8:
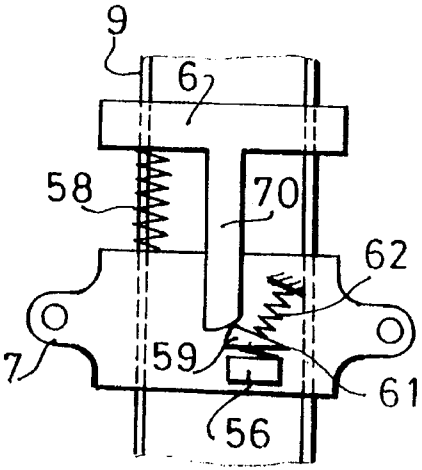
FIG. 8 is a view, in elevation, similar to FIG. 1 to 6, of a fifth embodiment of the safety device according to the invention.

In the embodiment of the safety device of FIG. 8, the two slides 6, 7 are coupled via prestressed tension spring 58 and one of the two slides, for example the slide 7, is equipped with a component 59 pivoted about a pin 61. The component 59 interacts with an electrical switch 56 and is urged by a spring 62, one end of which is fixed to the slide 7, towards a position corresponding to a first state of the switch 56. The slide 6 is fitted with a finger 70, the end of which interacts with the component 59 so as to keep the latter, against the return force of the spring 62, in an angular position corresponding to the second state of the switch 56, as represented in FIG. 8. The component 59 and the switch 56 are kept in this state as long as the elastic element 58 does not undergo an extension greater than that corresponding to a predetermined value. The switch 56 forms part of a supply circuit for the geared motor unit 5 capable of reversing the direction of the latter when the switch 56 changes state, so as to free the movable member. This electrical circuit may either be that of FIG. 11 or that of FIG. 12.

Thus, if the two slides 6, 7 separate by too great a distance following an extension of the spring 58, which is itself caused by the interposition of an obstacle between the movable member and the frame which surrounds it, the component 59 will be freed of any contact with the finger 70 which is retracted and therefore will pivot about the pin 61, thereby releasing the switch 56. The latter changes state and the electrical system of FIG. 11 or FIG. 12 reverses the direction of rotation of the motor.

Application of the invention to window lifters of the toothed-sector and swing-arm type (FIG. 13 to 16).

In this family of electromechanical safety devices, applied to window lifters of the arm and toothed-sector type, the arm 61 raises or lowers the window (not shown) by rocking about a pin 60. The arm 61 is driven by the sector 63 with which it rocks about the pin 60 in order to raise or lower the window. The toothed sector 63 is in engagement with the output gear 64 of a geared motor unit 65, the input gearwheel 66 of which is driven by a worm 67. It is therefore possible to provide a safety device which enables the arm 61 and the sector 63 to be uncoupled automatically above a load of predetermined value.

Figures 13, 14:
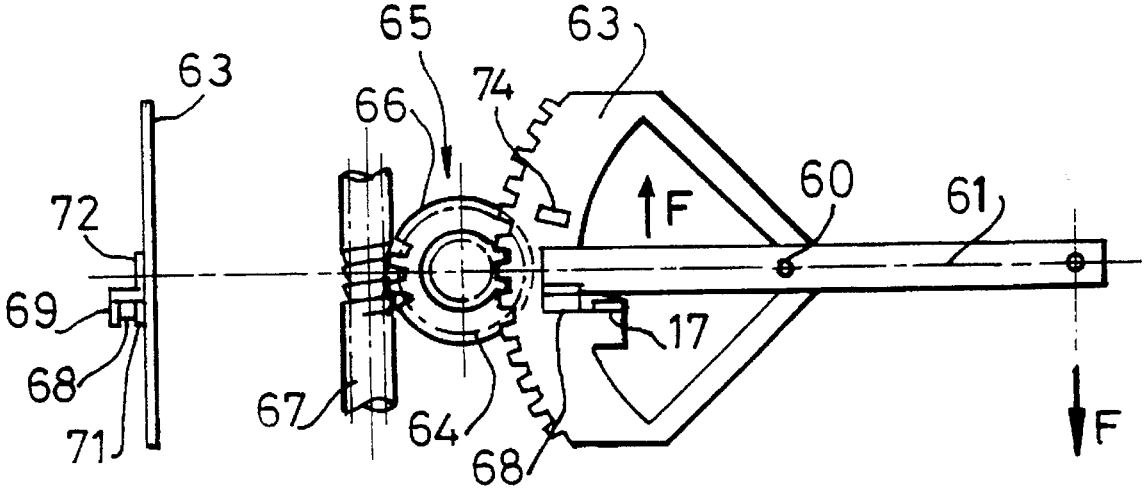
FIGS. 13, 14, 15, 16 are views, in partial elevation, of window lifters of the toothed-sector and swing-arm type, equipped with three different embodiments of the safety device according to the invention.

In the embodiment illustrated in FIG. 13 and 14, the means for coupling and load detecting between the arm 61 and the sector 63 comprise a magnet 68 fixed to one of the elements 61 and 63, namely the sector 63 in the example represented, this being by means of two armature plates 69, 71 between which it is inserted, the whole assembly being supported by the sector 63. Additionally, the safety device comprises a ferromagnetic component fixed to the arm 61, for example a L-shaped component 72.

The component 72, produced especially from steel sheet, may be a folded element made as a single piece with the arm 61 or may be attached to the latter. It is placed in contact with the armatures 69, 71 which concentrate the flux of the magnet 68 onto their contact surfaces. The component 72 is therefore attracted by the armatures 69, 71 with a certain force, and thus retains the arm 61 held fast to the sector 63, as long as the load F exerted on the arm 61 remains insufficient to overcome the attractive force of the magnet 68 (given the length of the lever arms on either side of the pin 60). On the other hand, if the load F on the window exceeds a predetermined limiting value, the arm 61 will lift off from the armatures 69, 71 of the magnet 68 and therefore uncouple the window from the driving motion supply by the sector 63.

An electrical switch 17 is mounted on the sector 63 so as to be kept by the arm 61 in a first state when the two elements 61, 63 are linked by the attractive force of the magnet 68 on the plate 72, and to switch into a second state when a load above the attractive force of the magnet 68 moves the arm 61 (driven element) away from the driving element, constituted by the sector 63 carrying the magnet. Depending on the case, the switch 17 forms part of one of the electrical circuits for controlling the direction of rotation of the motor of the geared motor unit 65, these being illustrated in FIG. 9 and 10.

The safety device of FIG. 13 and 14 is advantageously equipped with a limit stop 74 for stopping the arm 61 or 73, after the latter has become detached from the sector 63 and before reversal of the direction of rotation of the motor for driving the sector 63.

Of course, the various constituent members of the safety system of FIG. 13 and 14 may be mounted on the sector 63 and the arm 61 in an arrangement opposite to the one represented: for example the switch 17 will be mounted on the arm 61.

Figure 15:
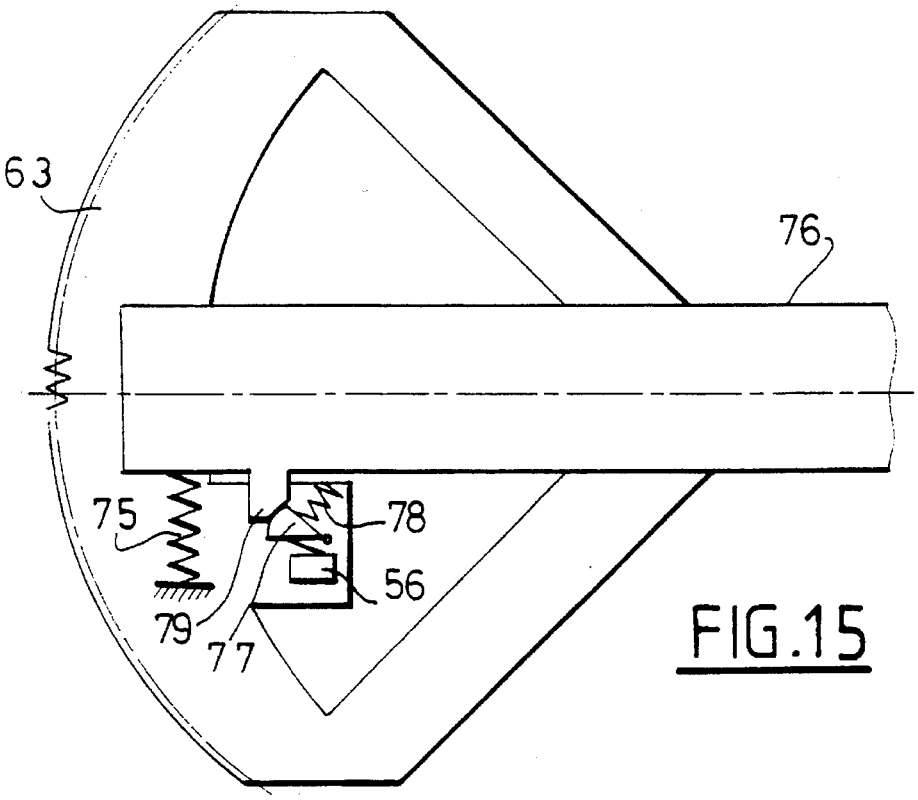

The embodiment of the safety system illustrated in FIG. 15 comprises coupling means constituted by a prestressed elastic tension element 75 between the arm 76 and the sector 63, for example a helical spring. A component 77, forming a catch, is pivoted to the sector 63 and interacts with an electrical switch 56 (FIG. 11 and 12). The catch 77 is urged by a spring 78, one end of which is attached to the sector 63, towards a position corresponding to a first state of the switch 56. The arm 76 is fitted with a finger 79 interacting with the component forming the catch 77, so as to keep the latter, against the return force of the spring 78, in an angular position corresponding to the second state of the switch, as long as the spring 75 does not undergo an extension above that corresponding to the predetermined value already mentioned.

Of course, the positions of the finger 79, of the catch 77 and of its return spring 78 on the arm 76 and the sector 63 may be reversed with respect to those represented in FIG. 15.

Figure 16:
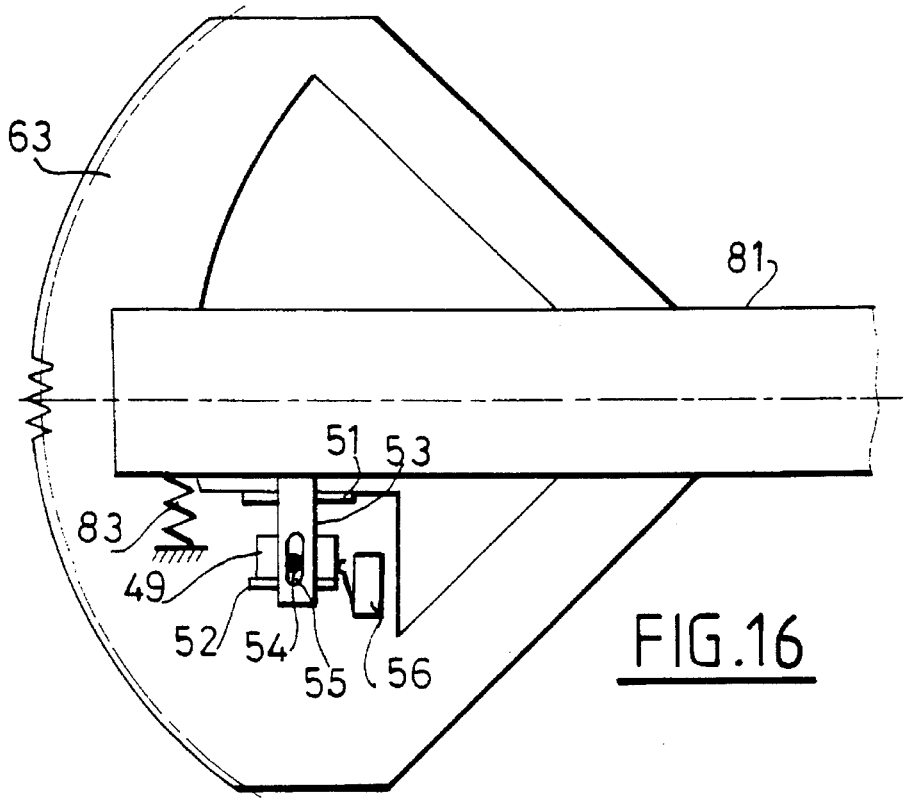

In the embodiment represented in FIG. 16, the means for coupling the driving element, formed by the sector 63, and the driven element constituted by the arm 81, as well as the load-detecting means, comprise an elastic tension element 83, for example a helical spring, connecting the arm 81 and the sector 63. Moreover, this safety device is virtually the same as that represented in FIG. 6 and 7 for cable-type window lifters. Its constituent elements have therefore been assigned the same numerical references, the sole difference with the system of FIG. 6 and 7 residing in the fact that the slides 6, 7 are, in this case, replaced respectively by the arm 81 and the sector 63. FIG. 16 illustrates, like FIG. 6 and 7, a mechanical-memory system by means of the magnet 49 which may adopt two stable positions: an initial position, clinging against the plate 52, and a detection position in which it clings against the plate 51, in which position it releases the switch 56.

The constructions of the safety device having a single stable position (FIG. 3 to 5, 13 and 14) do not have mechanical memory as they only have a single stable position, and must therefore be associated with the circuits of FIG. 9 and 10. The constructions of FIG. 6 to 8 and 15 to 16 have two stable positions, and therefore a mechanical memory, and they are consequently associated with the circuits of FIG. 11 or 12 which are not self-supplied.

In the various embodiments of the invention, the switches and their control circuits constitute a current-loop ("fail safe") device, which makes it possible to guarantee that the circuit operates correctly, and they are able to make the system safe.

Moreover, the various springs used, for example 75 in FIG. 15, 16 in FIG. 3, 48 in FIG. 6, etc., are prestressed, contrary to the springs of the aforementioned previous documents (for example that of U.S. Pat. No. 2,461,085). They may thus be released above the load threshold with an extremely high sensitivity, which constitutes an appreciable advantage compared to the previously known devices.

The invention is capable of undergoing various embodiment variants. Thus, it is especially clear that the arrangement relating to the coupling and load-detecting elements on the slides 6 and 7 may be reversed with respect to those represented. Likewise, a single, suitably arranged catch may replace the two catches 24 and 25 of FIG. 4.

In the various embodiments of the invention, the safety system has the advantage of being relatively easy to manufacture and therefore inexpensive.

We claim:

1. In a safety device for vehicular electrical openers having an electrical motor with an electrical supply circuit, said electrical motor controlled by a switch forming part of said electrical supply for said motor, a movable member driven by a cable, a kinematic chain for driving said cable, and electromechanical coupling and load-detecting means for coupling and detecting a load between a driving element of said kinematic chain and a driven element of said kinematic chain, said driven element fixed to said movable member, said coupling and detecting means effective to automatically uncouple said driving and driven elements from each other in the event said load exceeds a predetermined value, the improvement comprising: a driving slide fixedly attached to said cable, a driven slide fixedly attached to said movable member, said electromechanical coupling and load-detecting means provided between said driving slide and said driven slide and being arranged so as to automatically uncouple said driving slide and said driven slide from each other in the event said load exceeds said predetermined value.

2. A device according to claim 1, wherein said electromechanical coupling and load- detecting means comprises:

prestressed elastic tension element coupling said driving slide and said driven slide, said prestressed elastic tension element undergoing an extension separating said driving and driven slides in response to said load, and said switch fixed to one of said slides and associated with the other of said slides so as to change state when the extension of said prestressed elastic tension element exceeds the extension caused by a load of said predetermined value, wherein the direction of rotation of said electrical motor reverses when said switch changes state.

3. A device according to claim 1, wherein said electromechanical coupling and load-detecting means comprises:

a) a first catch and a second catch, said first and second catches pivoted on respective pins fixed to one of said driving or driven slides;

b) a finger member fixed to the other of said driving or driven slides;

c) a recess formed in said first catch adapted to engage said finger member;

d) a spring, one end of said spring being fixed to said one of said driving or driven slides, the other end of said spring being fixed to said second catch;

e) said switch fixed to one of said driving or driven slides and associated with the other of said driving or driven slides so as to change state when said driving slide and said driven slide are uncoupled; and f) wherein said second catch is urged by said spring into bearing contact against said first catch in such manner that said finger member remains engaged in said recess of said first catch thereby coupling said driving and driven slides so long as the load transmitted to said finger by said first catch remains below a value determined by the tension of said spring, wherein the direction of rotation of said electrical motor reverses when said switch changes state.

4. A device according to claim 1, wherein said coupling and load-detecting means comprises:

a) a first armature fixed to one of said driving or driven slides;

b) a second armature fixed to the other of said driving or driven slides;

c) a magnet positioned between said first and second armatures, said magnet generating an attractive force such that said driving and driven slides are maintained in fixed relation to one another;

d) said switch carried by one of said driving or driven slides and associated with the other of said driving or driven slides so as to change state when said driving and driven slides are uncoupled; and e) wherein when the load between said driving and driven slides exceeds the attractive force generated by said magnet, said slides are uncoupled, said switch changes state, and the direction of rotation of said electrical motor reverses.

5. Device according to claim 1, wherein said coupling and load-detecting means comprises:

a) a prestressed elastic tension element connecting said driven slide and said driving slide, said prestressed elastic tension element undergoing an extension separating said driving and driven slides in response to said load;

b) a magnet fixed to one of said driving or driven slides;

c) first and second ferromagnetic plates located on either side of said magnet, said ferromagnetic plates defining first and second stable positions of said magnet;

d) magnet drive and guide means carried by said other of said driving or driven slide and adapted to move said magnet from one of said first or second stable positions to the other of said first or second stable positions when said extension of said prestressed elastic tension element exceeds the extension caused by a load of said predetermined value;

e) said switch interacting with said magnet so as to change state when said magnet changes from one stable position to the other; and f) wherein the direction of rotation of said electrical motor reverses when said switch changes state.

6. Device according to claim 5 wherein said magnet guide and drive means comprises:

a) a finger member having a guide slot, said finger member projecting from one of said slides and extending opposite said magnet; and b) a rod attached to said magnet and slidingly positioned in said guide slot.

7. Device according to claim 1, wherein said coupling and load detecting means comprises:

a) a prestressed elastic tension element connecting said driving slide and said driven slide, said prestressed elastic tension element undergoing an extension separating said driving and driven slides in response to said load;

b) a component member pivoted on one of said slides, said component member interacting with said switch;

c) a spring having a return force, said spring urging said switch towards a position corresponding to a first state of said switch;

d) a finger member extending from the other of said slides interacting with said component member so as to force said component member to an angular position against said return force of said spring and maintaining said switch in a second state so long as the extension of said prestressed elastic tension element does not exceed the extension caused by a load of said predetermined value; and e) wherein the direction of rotation of said electrical motor reverses when said switch changes state.

8. Device according to claim 1, further comprising limiting means for limiting movement of said driving slide and said driven slide relative to each other, said limiting means comprising a component attached to one of said slides and having a portion extending along the other of said slides, said component having a hook portion adapted to limit movement of said other of said slides when said hook portion of said component bears against said other slide.

9. The device according to claim 1, wherein said movable member being selected from the group consisting of a window or a sunroof.

10. In a safety device for vehicular window openers comprising a kinematic chain provided with a geared motor unit having an input gear and an output gear, an electrical motor gearingly driving the input gear of said geared motor unit, an electrical supply circuit providing electric power to the motor and an electrical switch forming part of the electrical supply circuit of said motor, a toothed sector forming a driving element in engagement with said output gear of said geared motor unit, a swing arm forming a driven element, said swing arm mechanically linked to said toothed sector and carrying a window, and electromechanical coupling and load-detecting means for electromechanically coupling and detecting a load between said toothed sector and said swing arm, said coupling and load-detecting means adapted to uncouple said toothed sector and swing arm from each other in the event said load exceeds a predetermined value, the improvement comprising:

a) a magnet fixed to one of said toothed sector or said swing arm;

b) a ferromagnetic plate carried by the other of said swing arm or toothed sector against which said magnet normally attaches due to an attractive force provided by said magnet coupling said toothed sector and said swing arm;

c) said electrical switch mounted on one of said toothed sector or said swing arm and associated with the other of said swing arm or toothed sector so as to change state when said toothed sector and said swing arm are uncoupled by a load exceeding said attractive force provided by said magnet; and d) wherein the direction of rotation of said electrical motor reverses when said switch changes state.

11. Device according to claim 10, further comprising a limit stop for limiting movement of said toothed sector and said swing arm relative to each other after said toothed sector and said swing arm have been detached from each other and before reversal of direction of rotation of said electrical motor.

12. In a safety device for vehicular window openers comprising a kinematic chain provided with a geared motor unit having an input gear and an output gear, an electrical motor gearingly driving the input gear of said geared motor unit, an electrical supply circuit providing electric power to the motor and an electrical switch forming part of the electrical supply circuit of said motor, a toothed sector forming a driving element in engagement with said output gear of said geared motor unit, a swing arm forming a driven element, said swing arm mechanically linked to said toothed sector and carrying a window, and electromechanical coupling and load-detecting means for electromechanically coupling and detecting a load between said toothed sector and said swing arm, said coupling and load-detecting means adapted to uncouple said toothed sector and swing arm from each other in the event said load exceeds a predetermined value, the improvement comprising:

a) a prestressed elastic tension element connecting said toothed sector and said swing arm, said prestressed elastic tension element undergoing an extension separating said toothed sector and said swing arm in response to said load;

b) one of said toothed sector or said swing arm equipped with a component member pivoted to said one of said toothed sector or said swing arm;

c) a spring having a return force which urges said component member against said electrical switch towards a first state of said switch;

d) a finger member fitted to the other of said toothed sector or said swing arm;

e) said finger member interacting with said component member so as to keep said component member in an angular position corresponding to a second state of said switch against the return force of said spring so long as said prestressed elastic tension element does not undergo an extension greater than that corresponding to an extension caused by said predetermined force; and f) wherein the direction of rotation of said electrical motor reverses when said switch changes state.

13. In a safety device for vehicular window openers comprising a kinematic chain provided with a geared motor unit having an input gear and an output gear, an electrical motor gearingly driving the input gear of said geared motor unit, an electrical supply circuit providing a electric power to the motor and an electrical switch forming part of the electrical supply circuit of said motor, a toothed sector forming a driving element in engagement with said output gear of said geared motor unit, a swing arm forming a driven element, said swing arm mechanically linked to said toothed sector and carrying a window, and electromechanical coupling and load-detecting means for electromechanically coupling and detecting a load between said toothed sector and said swing arm, said coupling and load-detecting means adapted to uncouple said toothed sector and swing arm from each other in the event said load exceeds a predetermined value, the improvement comprising:

a) an elastic tension element connecting said swing arm and said toothed sector, said elastic element being prestressed and undergoing an extension separating said toothed sector and said swing arm from each other in response to said load;

b) a magnet carried by one of said swing arm or toothed sector which can move between a first stable position and a second stable position and associated with said switch such that said switch changes state when said magnet changes from one stable position to the other;

c) said first stable position being one in which said toothed sector and said swing arm are coupled and said second stable position of said magnet being one in which said toothed sector and said swing arm are uncoupled by extension of said prestressed elastic tension element exceeding the extension caused by a load of said predetermined value; and d) wherein the direction of rotation of said electrical motor reverses when said switch changes state.

14. Device according to claim 13, further comprising magnet drive and guide means, said magnet drive and guide means comprising:

a) a finger member having a guide slot and projecting from one of said toothed sector or said swing arm opposite said magnet;

b) a rod attached to said magnet and slidingly positioned in said guide slot;

c) first and second ferromagnetic plates attached to one of said toothed sector or said swing arm; and d) wherein said first and second ferromagnetic plates are spaced apart on either side of said magnet, and define said first and second stable positions of said magnet when said magnet is magnetically attached to said first or second of said ferromagnetic plates.

* * * * *